United States Patent [19]

Brandtjen

[11] 4,142,308

[45] Mar. 6, 1979

[54] LINKAGE MECHANISM FOR DIGGING IMPLEMENT

[75] Inventor: Sheldon J. Brandtjen, Green Bay, Wis.

[73] Assignee: Northwest Engineering Company, Green Bay, Wis.

[21] Appl. No.: 882,079

[22] Filed: Mar. 1, 1978

[51] Int. Cl.[2] ..... E02F 5/02; E02F 3/74

[52] U.S. Cl. ..... 37/103; 414/694; 414/718

[58] Field of Search ..... 37/103, 117.5, 118; 214/131 R, 138 R, 138 D, 141, 779

[56] References Cited

U.S. PATENT DOCUMENTS

| | | | |
|---|---|---|---|
| 2,828,038 | 3/1958 | Dorkins | 214/138 R X |
| 3,166,205 | 1/1965 | Symmank | 214/138 R |
| 3,245,559 | 4/1966 | Russell | 214/138 R |
| 3,445,015 | 5/1969 | Sampo et al. | 214/138 R |
| 3,653,131 | 4/1972 | Pilch | 214/141 X |
| 3,688,930 | 9/1972 | Shumaker | 214/141 |

*Primary Examiner*—E. H. Eickholt

*Attorney, Agent, or Firm*—Andrus, Sceales, Starke & Sawall

[57] ABSTRACT

A crane-excavator or the like has a boom, a saddle, a translatable stick and a digging implement. A stick cylinder and implement cylinder are provided. The ends of the stick and implement cylinder rams are connected to common lever arms which are pivoted to the stick on a transverse axis which is offset from the ram-lever connections and form the stick center line. The lever arms are connected to the digging implement in a manner so that the combined forces from both rams are transmitted to the implement to pivot the latter about its axis. The simultaneous movement of the stick cylinder ram and the implement cylinder ram causes the stick to extend or retract, thus causing a shift of the implement-stick pivot axis relative to the saddle. The implement may be raised or lowered even when the stick ram is fixed in length.

13 Claims, 10 Drawing Figures

LINKAGE MECHANISM FOR DIGGING IMPLEMENT

PRIOR ART OF INTEREST

U.S. Pat. No. 3,166,205, Symmank, Jan. 19, 1965; 3,688,930, Shumaker, Sept. 5, 1972.

BACKGROUND AND SUMMARY OF THE INVENTION

This invention relates to a linkage mechanism for an implement, such as a bucket, dipper or the like.

In material handling apparatus such as mobile power crane-excavators, a load carrying member such as a boom is provided with an outer end to which is pivoted a saddle block. A translatable stick passes through the saddle block and is movable by a stick cylinder ram. A material handling implement is pivotally attached to the outer end of the stick. An implement cylinder is mounted to the assembly to pivot the implement on the stick for digging, dumping and the like.

In some instances, as with a bucket which digs or crowds forwardly into the ground and then must lift its load for subsequent transport and dumping, the implement cylinder must provide a so-called "breakout force" in order to move through the material being dug.

Heretofore, the capacity of the implement cylinder sometime had to be increased for the purpose of providing additional breakout force. Heretofore, this increased capacity was achievable only with a larger implement cylinder and consequent greater power demand. Furthermore, prior constructions were such that the speed of implement roll was solely dependent on the speed of action of the implement cylinder.

It is the aim of the present invention to provide a construction to augment the normal force moment of roll about the implement pivot axis with an additional moment created by structure other than the implement cylinder; thus reducing the need for an oversized capacity implement cylinder.

It is a further aim of the invention to augment the position of the digging implement during pivoting thereof to thereby increase its speed of operation.

An additional aim is to provide a device accomplishing the above aims which nevertheless permits the implement cylinder ram to pivot the digging implement even when the stick cylinder ram is fixed in length.

In accordance with one aspect of the invention, the ram of the stick cylinder is utilized to augment the force moment of the digging implement about its pivot axis, thus supplementing the force moment created by the ram of the implement cylinder. The total force moment is thereby increased.

In the present embodiment, the ends of the stick and implement cylinder rams are connected to common lever arms which are pivoted to the stick on a transverse axis which is offset from the ram-lever connections and from the stick center line. The lever arms are connected to the digging implement in a manner so that the combined forces from both rams are transmitted to the implement to pivot the latter about its axis. In this embodiment, the stick cylinder ram is not connected to the stick directly, but rather through the lever arms.

In accordance with another aspect of the invention, the augmentation of force moment automatically augments the positioning of the digging implement in that the pivot axis of the implement simultaneously shifts forwardly or rearwardly, thus changing the speed of implement rotation during loading or dumping. In the present embodiment, the simultaneous movement of the stick cylinder ram and the implement cylinder ram causes the stick to extend or retract, thus causing a shift of the implement pivot axis relative to the saddle. A forward-and-roll or rearward-and-roll effect is thereby created, giving the operator increased flexibility in moving the implement.

In accordance with yet another aspect of the invention, the implement may be pivoted even when the stick ram is fixed in length.

In the present embodiment, the pivot axis between the stick cylinder ram and levers, while selectively not shiftable longitudinally, is movable vertically to accommodate lever and implement pivoting.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
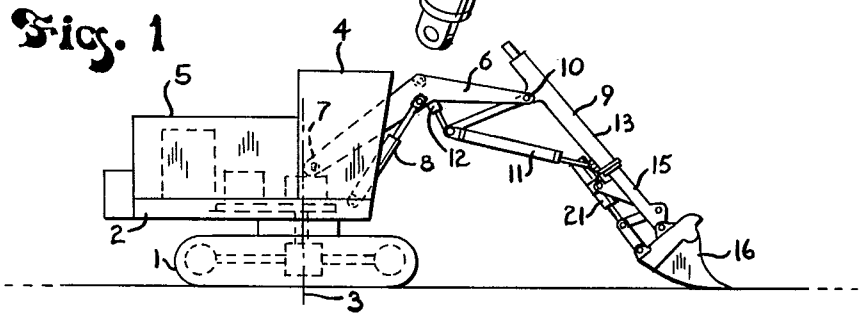
FIG. 1 is a schematic side elevation of a mobile power crane-excavator embodying the inventive concept.

As shown in FIG. 1 of the drawings, the concept of the invention is adaptable for use in a material handling crane-excavator type device mounted on crawler treads 1 and which includes a platform 2 pivotable or swingable about an upright axis 3. Platform 2 supports an operator's cab 4 as well as a rear end enclosure 5 for equipment or the like.

A load carrying member, such as a boom 6, is secured to suitable framework on platform 2 and is pivotable at 7 as by a pair of boom cylinders 8 in the usual manner. A saddle block 9 is pivotally mounted as at 10 to the outer end of boom 6, and may be pivotally actuated by pairs of cylinders 11 and 12.

Figure 2:
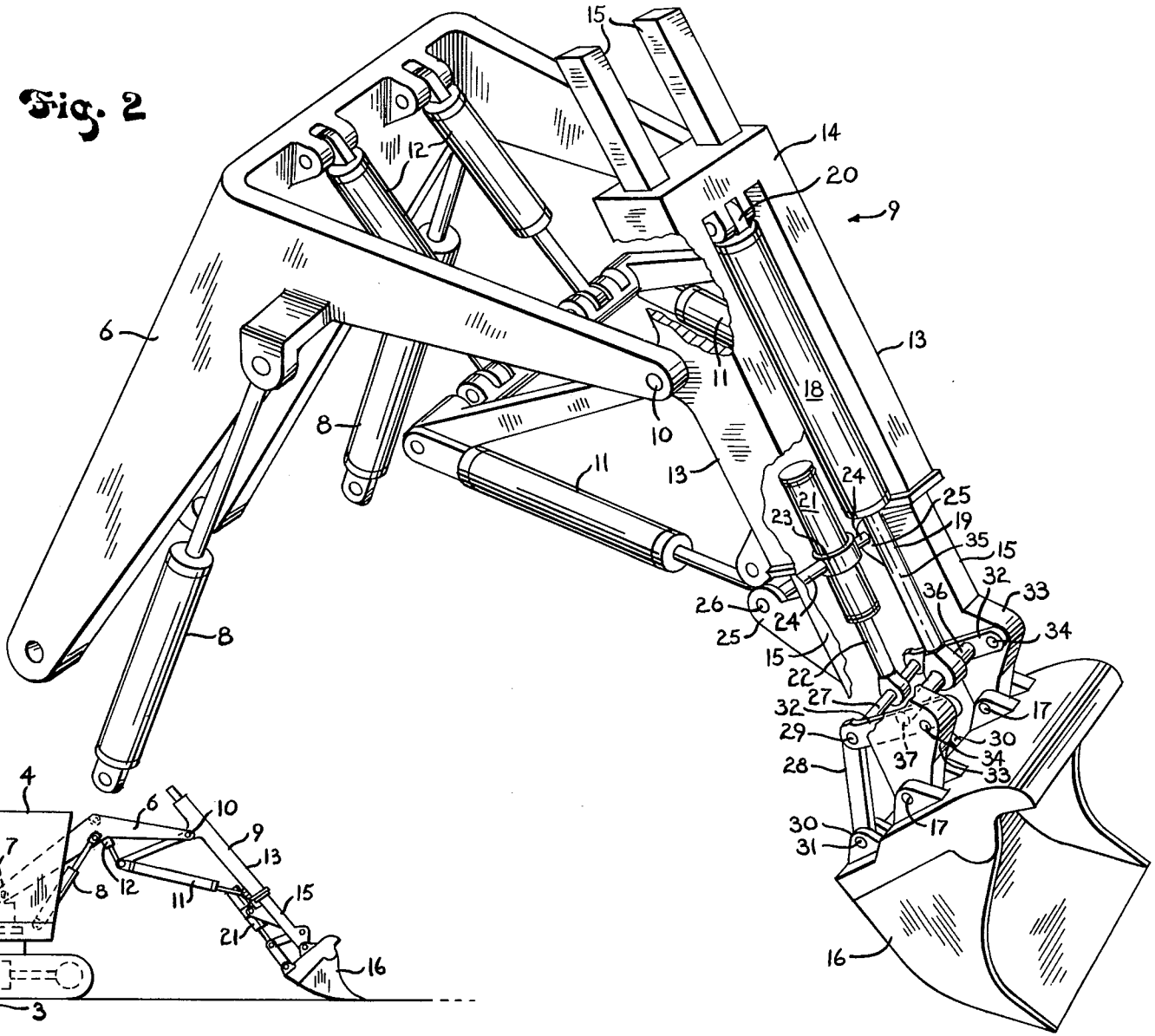
FIG. 2 is an enlarged perspective view of the front end portion of the crane-excavator with parts broken away.

As best seen in FIG. 2, saddle block 9 is of generally inverted U-shape and comprises a pair of spaced longitudinally extending legs 13 joined at their inner ends by a cross-brace 14. Legs 13 are of hollow tubular construction and each leg receives a stick 15 which is freely and reciprocally slidable therein. Sticks 15 extend longitudinally forwardly and connect at their outer ends to a digging implement 16, as on the horizontal transverse roll or pivot axis 17.

Implement 16 may be of any suitable type, including backhoe buckets, but in the present embodiment is shown as a shovel bucket which is pivotable about axis 17.

A stick cylinder 18 and associated ram 19 are provided to extend and retract sticks 15 in unison. For this purpose, the inner end of cylinder 18 is pivotally attached to cross brace 14 as at 20 and extends longitudinally forwardly between the stick elements, with ram 19 also extending forwardly toward bucket 16.

A longitudinal secondary or bucket cylinder 21 having a ram 22 is disposed between sticks 15. In the present embodiment, bucket cylinder 21 is fixedly mounted in any suitable well-known manner to an annular collar 23 which is connected through trunnions 24 to end bearings 25 on sticks 15 for pivoting about a transverse axis 26. Ram 22 extends forwardly from its bucket cylinder 21 and is centrally connected to a shaft 27, the ends of which are pivotally mounted to the rearward ends of links 28, as on transverse pivot axis 29. The forward ends of links 28 pivotally join to bearings 30 on bucket 16, as on transverse axis 31 which is spaced from axis 17.

Figure 3:
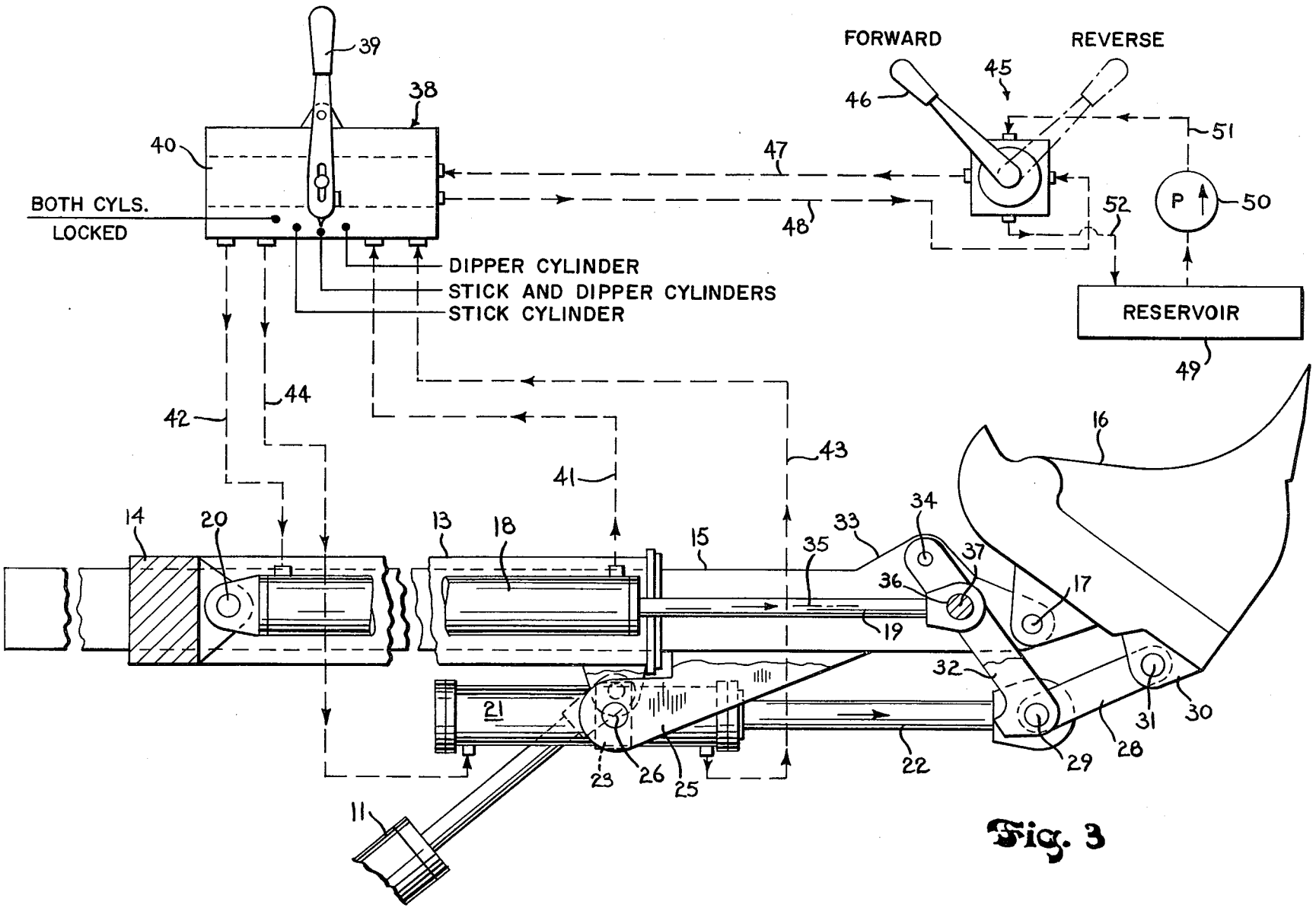
FIG. 3 is a schematic showing of the control system for the digging implement.

In accordance with one aspect of the invention, it is desirable to utilize stick ram 19 to augment bucket ram 22, especially when the bucket is to be rolled against the resistance of the material being dug. For this purpose, a pair of lever arms 32 are pivotally connected at their respective lower ends to the connection at axis 29 between shaft 27 and links 28. Arms 32 extend generally perpendicular to sticks 15 and are pivotally mounted to projections 33 thereon as on transverse pivot axis 34 which is offset from the central longitudinal center line 35 of stick ram 19. Referring to FIG. 3 in this embodiment axis 34 is on the side of ram 19 remote from the respective bucket cylinder ram 22. The outer end of stick cylinder ram 19 is pivotally connected to a shaft 36, the ends of which are secured to the spaced lever arms 32 as on a horizontal transverse axis 37 which is parallel to and disposed between axes 29 and 34.

Figure 4:
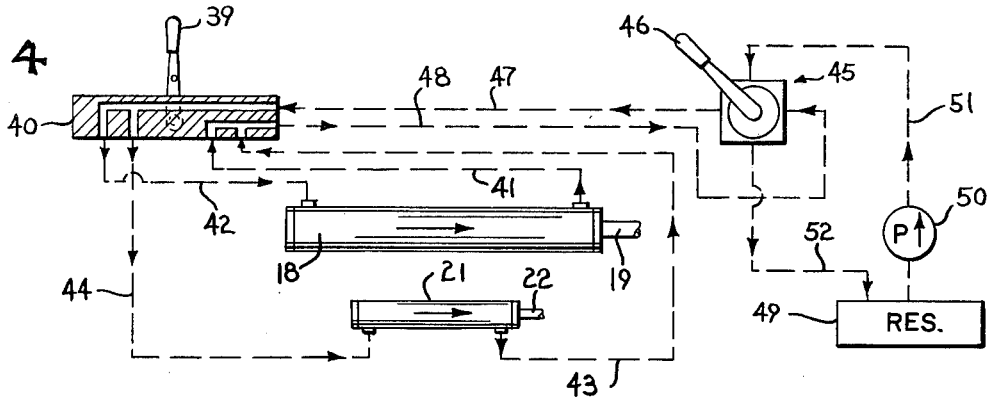
FIG. 4 is a schematic showing of the system during augmentation of the force moment about the pivot axis of the digging implement.
Figure 7:
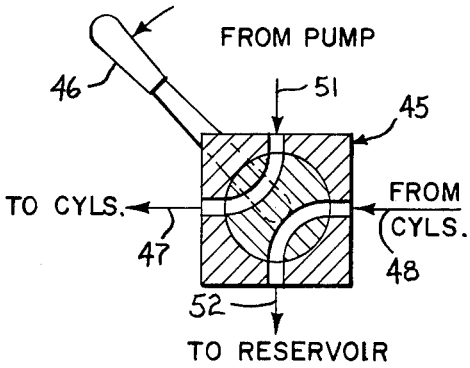
FIGS. 7 and 8 are schematic views of the forward-reverse valve in its two actuating positions.
Figure 8:
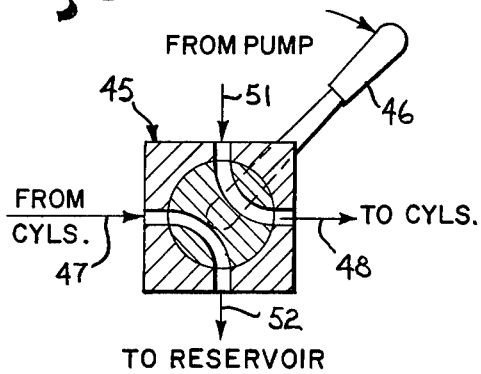

Referring to FIGS. 3 and 4 which show a schematic system for the apparatus, an operator's control includes a front panel 38, a handle 39 and a valve 40 controlled by the handle. Stick cylinder 18 is connected to valve 40 through suitable hydraulic lines 41, 42 while each bucket cylinder 21 is connected to the valve through lines 43, 44. A forward-reverse valve 45 having a handle 46 is also connected through lines 47, 48 to valve 40 and provides fluid flow from a reservoir 49 and pump 50 to the control system, as through lines 51, and 52. See also FIGS. 7 and 8.

In some instances, it may be preferable to utilize separate directional control valves and individual control levers in place of valves 40 and 45 and levers 39 and 46.

Selectively positioning handle 39 causes cylinder rams 19 and 22 to be activated in unison or individually.

When handle 39 is vertical and handle 46 is in the forward mode, as shown in FIGS. 3 and 4, bucket cylinder ram 22 extends forwardly to raise bucket 16 about roll axis 17, through link 28. However, in view of the fact that rams 22 and 19 are connected to common lever arams 32, with pivot axis 37 between axes 29 and 34, extension of stick cylinder ram 19 in the same direction as ram 22 creates an additional force through arms 32, tending to pivot them forwardly about axis 34. This transmits an additional force moment to augment the roll of bucket 16 about axis 17. Thus, the bucket can be pivoted from its lowermost digging position in such a manner as to provide an increased "breakout force" without oversizing of bucket cylinder 21.

At the same time that both rams are extending simultaneously, the extension of stick cylinder ram 19 carries sticks 15 outwardly with it via lever arm 32. Since bucket 16 is effectively mounted to sticks 15, it will be automatically moved forwardly also.

Figure 5:
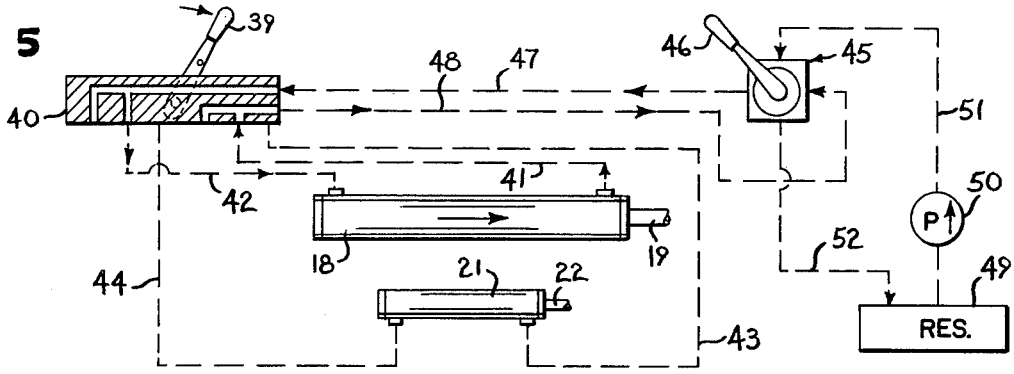
FIG. 5 is a view similar to FIG. 4 and showing actuation of the stick cylinder only.

In some instances, it may be desirable to extend or retract sticks 15 without pivoting bucket 16. This may occur, for example, during swing or travel of the crane-excavator. As shown in FIG. 5, when handle 39 is moved rightwardly, bucket cylinder 21 is blocked at valve 40 and stick cylinder ram 19 is driven forward to carry the sticks and bucket outwardly without pivoting. Since bucket cylinder 21 is mounted to sticks 15 through trunnions 24 and bearings 25, the cylinder 21 will be carried along forwardly with the sticks. Reversal of valve 45 will carry cylinder 21 and bucket 16 inwardly in a retractive movement. No bucket pivoting will occur.

Figure 6:
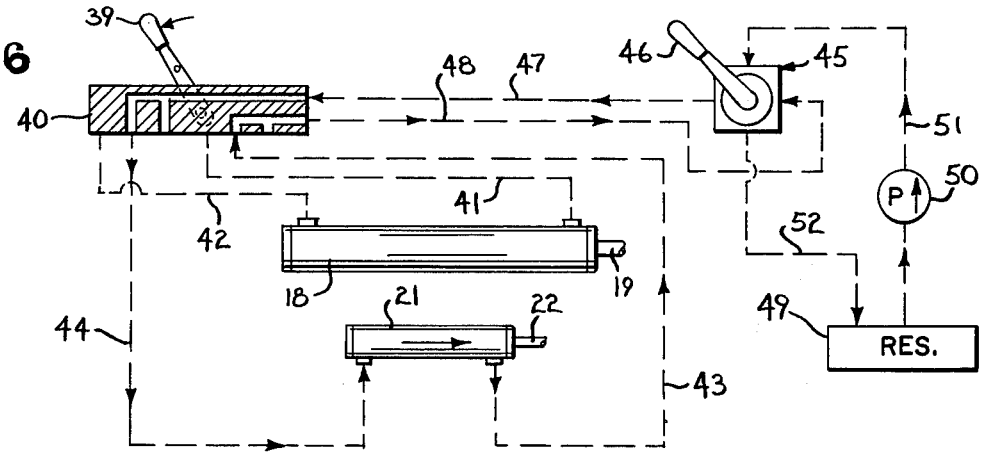
FIG. 6 is a view similar to FIG. 4 and showing actuation of the implement cylinder only.
Figure 9:
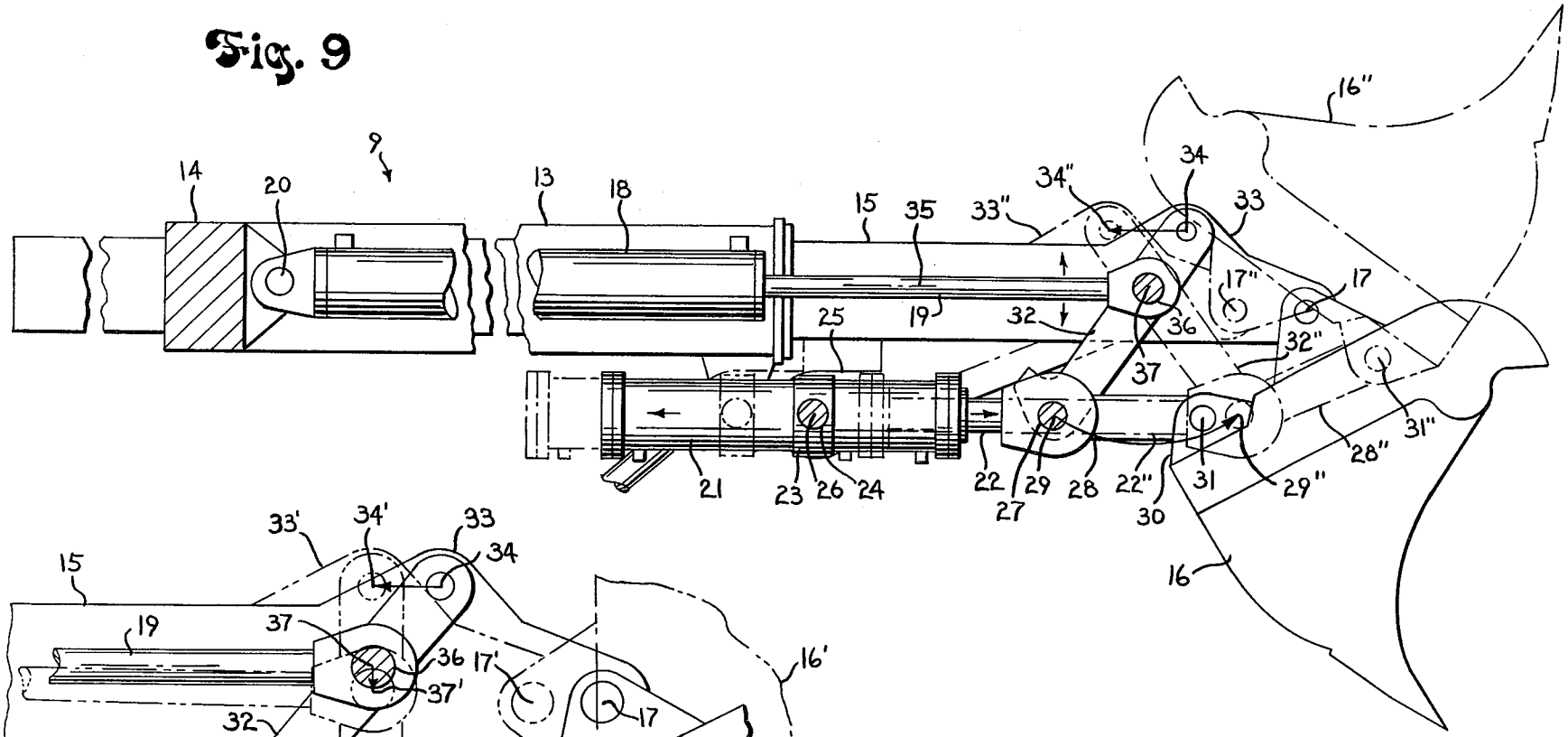
FIG. 9 is a schematic side elevation of the digging assembly, and showing the position of the parts at the fully dumped and fully loaded implement positions when the stick cylinder ram is fixed longitudinally and only the implement cylinder ram is actuated.
Figure 10:
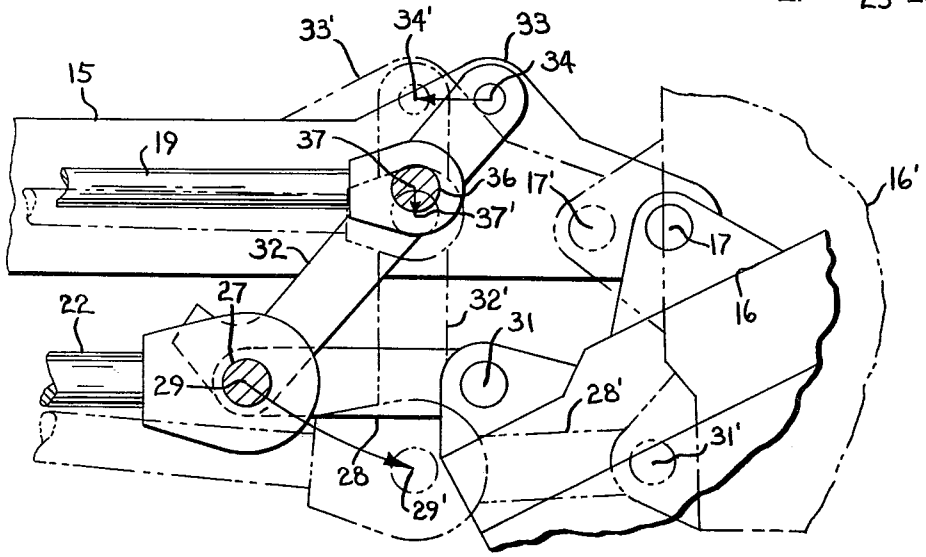
FIG. 10 is a fragmentary view of the outer end of the assembly showing the parts of FIG. 9 in fully dumped and intermediate positions.

Turning now to another aspect of the invention, in some instances it may be desirable to hold sticks 15 at a fixed length but to nevertheless roll bucket 16 upwardly for loading or downwardly for dumping. In this instance stick cylinder ram 19 would be locked in position by moving handle 39 to the left as shown in FIG. 6, thus blocking the outlets to cylinder 18 at valve 40. Cylinder 18 and ram 19 would thus function in this mode of the controls as a solid member of fixed length. At the same time, and in the case of loading, bucket cylinder ram 22 is extended outwardly to pivot bucket 16 about axis 17. FIGS. 9 and 10 illustrate how this can be accomplished through the linkage arrangement, utilizing axis 37 between the stick cylinder ram 19 and levers 32 as the primary pivot.

Referring first to FIG. 9, the structure shown in full lines illustrates the positions of the elements when bucket 16 is down and bucket cylinder ram 22 is retracted and ready for extension. As ram 22 is extended, as in FIG. 6, lever arms 32 pivot about axis 37 from a first angular position shown best in full lines in FIGS. 9 and 10 to an intermediate upright position 32' shown in phantom in FIG. 10.

Axis 37 cannot move longitudinally because ram 19 is locked. By the same token, axis 34 can only move longitudinally because it is tied to the longitudinally slidable sticks 15. Thus, something must give in order to be able to pivot arms 32 about axis 37. For this purpose, it is to be recalled that stick cylinder 18 is vertically pivotable at its inner end at 20. Thus, as arms 32 rotate about axis 37 from the full to the phantom position 32' of FIG. 10, stick cylinder 18 and its ram 19 are forced to swing downwardly about pivot 20, displacing axis 37 to the point 37'. This permits lever axis 34 to shift longitudinally rearwardly to point 34', carrying with it projections 33 to 33' and thus sliding sticks 15 slightly rearwardly.

At the same time, the lower ends of arms 32 shift forwardly, carrying axis 29 downwardly and forwardly in an arc to the new position 29'. In addition, links 28 will move to position 28', thus raising bucket 16 by pivoting the latter about axis 17. Axis 17 also shifts rearwardly to 17' because of its connection to the rearwardly moving sticks 15.

Continued extension of bucket cylinder ram 22 causes the elements to move from the intermediate phantom position of FIG. 10 to the final position shown in phantom in FIG. 9.

As levers 32 continue to pivot, axis 37 (and thus cylinder 18 and ram 19) gradually returns to its original position. Lever axis 34 continues rearwardly from point 34' to point 34'', carrying with it projections 33 from point 33' to point 33'' and thus further retracting sticks 15.

At the same time, the lower ends of arms 32 shift further forwardly, carrying axis 29 in a continuing arc from 29' to final position 29''. In addition, links 28 move from position 28' to position 28'', thus continuing to raise bucket 16 further about its pivot axis 17, which also shifts further rearwardly from 17' to its final position 17''.

The final position of levers 32 is shown at 32'' in FIG. 9.

It should be noted that because sticks 15 shift rearwardly during this operation, even though stick ram 19 is fixed against longitudinal movement, bucket cylinder 21 also shifts rearwardly with the sticks to the phantom position shown in FIG. 9.

In the event it is desired to dump the raised bucket 16'' by the sole use of bucket cylinder ram 22 and when stick ram 19 is locked by valve 40 as in FIG. 6, forward-reverse handle 46 need only be moved rightwardly to its reverse mode position. The sequence of movement of the elements as described above will then merely reverse itself.

When the stick cylinder 18 and ram 19 are held at a total fixed length, it is seen that actuation of bucket cylinder ram 22 causes sticks 15 to translate and bucket 16 to rotate. This simultaneous action increases the rotational speed of the bucket in the dumping direction which shortens the total time cycle. In the dumping direction, this faster rotational speed of the bucket also helps to discharge sticky material. Also, as a result of the stick moving outward while dumping, the actual dumping radius is increased. The reverse is true while pivoting in the loading direction.

While the embodiment shown and described herein utilizes pairs of certain elements, such as sticks 15 and levers 32, a mechanism could be constructed with only single elements without departing from the spirit of the invention. By the same token, single elements disclosed herein could be converted to pairs.

The linkage mechanism of the present invention provides a unique system of material handling implement control which is believed to be a substantial improvement over previously known systems.

Various modes of carrying out the invention are contemplated as being within the scope of the following claims particularly pointing out and distinctly claiming the subject matter which is regarded as the invention.

I claim:

1. In a crane-excavator or the like having a boom, a saddle mounted to said boom, a stick longitudinally translatable along said saddle, and a material handling implement mounted to said stick for pivotal movement about a transverse roll axis between extreme positions, the combination comprising:

(a) a stick cylinder connected to said saddle and with said stick cylinder having a ram extending longitudinally toward said implement, (b) an implement cylinder connected to said stick and fixed against longitudinal movement relative thereto and with said implement cylinder having a ram extending longitudinally toward said implement, (c) control means to actuate said rams simultaneously, (d) and means connecting said rams with said implement in a manner so that, when said control means actuates said rams, the force moment of implement pivoting about said roll axis reflects the force of both said rams.

2. The crane-excavator of claim 1 whereiin simultaneous actuation of said rams by said control means causes said roll axis to shift longitudinally while said implement pivots thereabout.

3. In a crane-excavator or the like having a boom, a saddle mounted to said boom, a stick longitudinally translatable along said saddle, and a material handling implement mounted to said stick for pivotal movement about a transverse roll axis between extreme positions, the combination comprising:

(a) a stick cylinder connected to said saddle and with said stick cylinder having a ram extending longitudinally toward said implement, (b) an implement cylinder connected to said stick and fixed against longitudinal movement relative thereto and with said implement cylinder having a ram extending longitudinally toward said implement, (c) link means connecting the end of said implement ram to said implement at an axis spaced from said roll axis, (d) a common lever arm pivotally connected to and joining the ends of both said rams, said lever arm being pivotally mounted to said stick, (e) and control means to selectively actuate both said rams simultaneously in the same direction so that the force of said stick ram acts through said lever arm to augment the force of said implement ram through said link means to thereby increase the total force moment of roll of said implement about said roll axis as the implement moves between said positions.

4. The crane-excavator of claim 3 wherein said common lever arm is pivotally mounted to said stick on a transverse axis offset from the longitudinal center line of said stick.

5. The crane-excavator of claim 4 wherein the pivotal connection of said stick ram to said lever arm is disposed between said offset axis and the pivotal connection of said implement ram to said lever arm.

6. The crane-excavator of claim 3 wherein:

(a) said stick ram and lever arm are pivotally connected on a further axis, (b) and said control means is selectively actuatable to a mode to lock said stick ram in longitudinal position and to simultaneously actuate only said implement ram.

7. The crane-excavator of claim 6:

(a) which includes means mounting said stick cylinder and its associated ram for vertical pivotal movement relative to said saddle, (b) said control means, when in said mode, serving as means to pivot said lever arm about said further axis while causing said stick ram to pivot vertically about said mounting means so that said stick ram remains in said locked longitudinal position.

8. The crane-excavator of claim 6 wherein pivoting of said lever arm about said further axis by said control means translates said stick relative to said saddle.

9. The crane-excavator of claim 8 wherein said stick is caused to retrack while said implement is being pivoted in one direction about said roll axis, and said stick is caused to extend while said implement is being pivoted in the opposite direction about said roll axis.

10. In a crane-excavator or the like having a boom, a saddle mounted to said boom, a stick longitudinally translatable along said saddle, and a material handling implement mounted to said stick for pivotal movement about a transverse roll axis between extreme positions, the combination comprising:

(a) a stick cylinder connected to said saddle and with said stick cylinder having a ram extending longitudinally toward said implement, (b) an implement cylinder connected to said stick and fixed against longitudinal movement relative thereto and with said implement cylinder having a ram extending longitudinally toward said implement, (c) link means connecting the end of said implement ram to said implement at an axis spaced from said roll axis, (d) a common lever arm pivotally connected to and joining the ends of both said rams, said lever arm being pivotally mounted to said stick, (e) said stick ram and lever arm being pivotally connected on a further axis, (f) means to lock said stick ram in longitudinal position, (g) and control means to actuate only said implement ram when said stick ram is locked.

11. The crane-excavator of claim 10:

(a) which includes means mounting said stick cylinder and its associated ram for vertical pivotal movement relative to said saddle, (b) said control means serving as means to pivot said lever arm about said further axis while causing said stick ram to pivot vertically about said mounting means so that said stick ram remains in said locked position.

12. The crane-excavator of claim 11 wherein pivoting of said lever arm about said further axis by said control means translates said stick relative to said saddle.

13. The crane-excavator of claim 12 wherein said stick is caused to retract while said implement is being pivoted in one direction about said roll axis, and said stick is caused to extend while said implement is being pivoted in the separate direction about said roll axis.

* * * * *